US006488093B2

(12) United States Patent
Moss

(10) Patent No.: US 6,488,093 B2
(45) Date of Patent: Dec. 3, 2002

(54) DEEP WATER INTERVENTION SYSTEM

(75) Inventor: Jeff H. Moss, Woodlands, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/813,611

(22) Filed: Mar. 21, 2001

(65) Prior Publication Data

US 2002/0134552 A1 Sep. 26, 2002

Related U.S. Application Data

(60) Provisional application No. 60/224,720, filed on Aug. 11, 2000.

(51) Int. Cl.[7] ..... B21B 29/12

(52) U.S. Cl. ..... 166/339; 166/365; 166/75.15

(58) Field of Search ..... 166/339, 360, 166/365, 70, 383, 75.15; 137/268

(56) References Cited

U.S. PATENT DOCUMENTS

| | | | | | |
|---|---|---|---|---|---|
| 2,713,909 | A | * | 7/1955 | Baker | 15/104.062 |
| 3,517,736 | A | | 6/1970 | Waldron | 166/0.5 |
| 3,545,474 | A | * | 12/1970 | Brown | 137/865 |
| 3,568,767 | A | | 3/1971 | Weiss | 166/0.5 |
| 3,602,300 | A | | 8/1971 | Jaffe | 166/0.5 |
| 3,674,123 | A | * | 7/1972 | Lewis et al. | 137/625.11 |
| 4,068,729 | A | * | 1/1978 | Peevey | 166/359 |
| 4,095,649 | A | | 6/1978 | Chateau et al. | 166/0.5 |
| 4,291,724 | A | * | 9/1981 | Miller | 137/555 |
| 4,407,361 | A | | 10/1983 | Van Winkle | 166/85 |
| 4,444,275 | A | * | 4/1984 | Beynet et al. | 166/339 |
| 4,553,600 | A | | 11/1985 | Vigouroux et al. | 166/343 |
| 4,784,527 | A | * | 11/1988 | Hunter et al. | 166/339 |
| 4,785,880 | A | * | 11/1988 | Ashton | 137/268 |
| 4,899,823 | A | | 2/1990 | Cobb et al. | 166/351 |
| 4,940,095 | A | | 7/1990 | Newman | 166/378 |
| 4,993,492 | A | | 2/1991 | Cressey et al. | 166/339 |
| 5,025,865 | A | * | 6/1991 | Caldwell et al. | 166/339 |
| 5,188,178 | A | * | 2/1993 | Noyes | 166/310 |
| 5,413,170 | A | | 5/1995 | Moore | 166/85 |
| 5,425,420 | A | | 6/1995 | Pringle | 166/242 |
| 5,813,455 | A | * | 9/1998 | Pratt et al. | 166/310 |
| 6,039,122 | A | * | 3/2000 | Gonzalez | 166/379 |
| 6,044,905 | A | * | 4/2000 | Harrison, III | 137/368 |
| RE36,723 | E | | 6/2000 | Moore et al. | 166/242.2 |
| 6,182,765 | B1 | * | 2/2001 | Kilgore | 166/102 |
| 6,223,825 | B1 | * | 5/2001 | Ingebrigtsen et al. | 166/345 |
| 6,269,875 | B1 | * | 8/2001 | Harrison et al. | 166/53 |
| 6,336,238 | B1 | * | 1/2002 | Tarlton | 15/104.062 |
| 2002/0040782 | A1 | | 4/2002 | Rytlewski et al. | 166/341 |

FOREIGN PATENT DOCUMENTS

| | | |
|---|---|---|
| WO | WO 92 14029 | 8/1992 |
| WO | WO 01 48352 | 7/2001 |
| WO | WO/02/20938 | 3/2002 |

OTHER PUBLICATIONS

Winchester, D. "DIODe—Drilling Independent Of Depth, A Seabed Exploration Drilling System", Offshore International, Jan. 1999, pp. 103–107.

The Centre for Marine & Petroluem Technology, "DIODe—Drilling Independent Of Depth, The DIODe Project", 1999, pp. 1–8.

Albright, J. N. et al. "Microhole Drilling And Instrumentation", 4th Int. HDR FORUM, Stasbourg, Sep. 28–30, 1998.

* cited by examiner

*Primary Examiner*—Thomas B. Will
*Assistant Examiner*—Thomas A. Beach
(74) *Attorney, Agent, or Firm*—Denise Y. Wolfs

(57) ABSTRACT

The well intervention system is a subsea deployed wire line, "stiff wire" (conventional wire-line located inside reeled tubing or embedded in the tubing wall), coil tubing, or reeled pipe unit landed on the existing subsea wellhead assembly or tree, wherein the unit includes as an additional novel component a "carousel" tool caddy. The carousel is utilized to allow the remote change-out of multiple tool strings that are included in the carousel prior to deployment, thereby eliminating the need for a "riser" conduit to the surface or the need to trip tools through the riser column for tool replacement. A method for conducting a well intervention activity, wherein the method includes the step of selecting a tool for the well intervention activity from a carousel tool caddy located in close proximity to the well. The invention system may also be employed in a similar manner to conduct repair or surveillance operations for pipelines or flowlines having flow control manifolds.

41 Claims, 3 Drawing Sheets

DEEP WATER INTERVENTION SYSTEM

REFERENCE TO RELATED APPLICATION

This application is based upon U.S. provisional patent application No. 60/224,720, filed Aug. 11, 2000.

FIELD OF THE INVENTION

This invention relates generally to the field of drilling, completion, and repair operations on wells in an underwater environment.

BACKGROUND OF THE INVENTION

Well interventions in subsea deepwater wells generally cost in excess of $200,000 per day (typically on the order of $10,000,000 per intervention) with operations usually being conducted by a floating deepwater drilling rig. Many operators are investigating the feasibility of utilizing purpose built well intervention vessels, but with anticipated operating costs in excess of $100,000 per day ($5,000,000 per intervention), costs are still too high for many reservoir management options to be economic. Reducing the cost of intervention would allow greater optimization of reservoir management with respect to both rate and ultimate recovery.

Accordingly, there is a need for an apparatus and operating procedure, which will allow reduction of costs associated with drilling, completion, and repair operations on wells in an underwater environment.

SUMMARY OF THE INVENTION

The subject invention provides an apparatus and a method for introducing tools into a subsea well or pipeline from a subsea location. The apparatus is an intervention system for servicing subsea wells or pipelines from a subsea location, comprising a tool delivery device, a reel to hold the tool delivery device, an injector head, a carousel tool caddy, a blow-out-preventer assembly, a power pack, a control pod, a test pump, and an open space frame. The system may be disconnected into two sections, allowing removal of the tool caddy, for replacement of tools at a remote location.

The subject invention also includes an improved method for introducing a tool into a subsea well or pipeline from a subsea location, comprising (for a well): (a) connecting a well intervention system to a subsea tree, wherein the well intervention system includes a reeled tool delivery device and a carousel tool caddy capable of holding one or more tools; (b) rotating the carousel tool caddy so that a selected tool is located over the well; (c) connecting a tool delivery device to the selected tool; and (d) introducing the selected tool into the well. The tools are used to conduct various intervention activities.

DETAILED DESCRIPTION OF THE INVENTION

Figure 1:
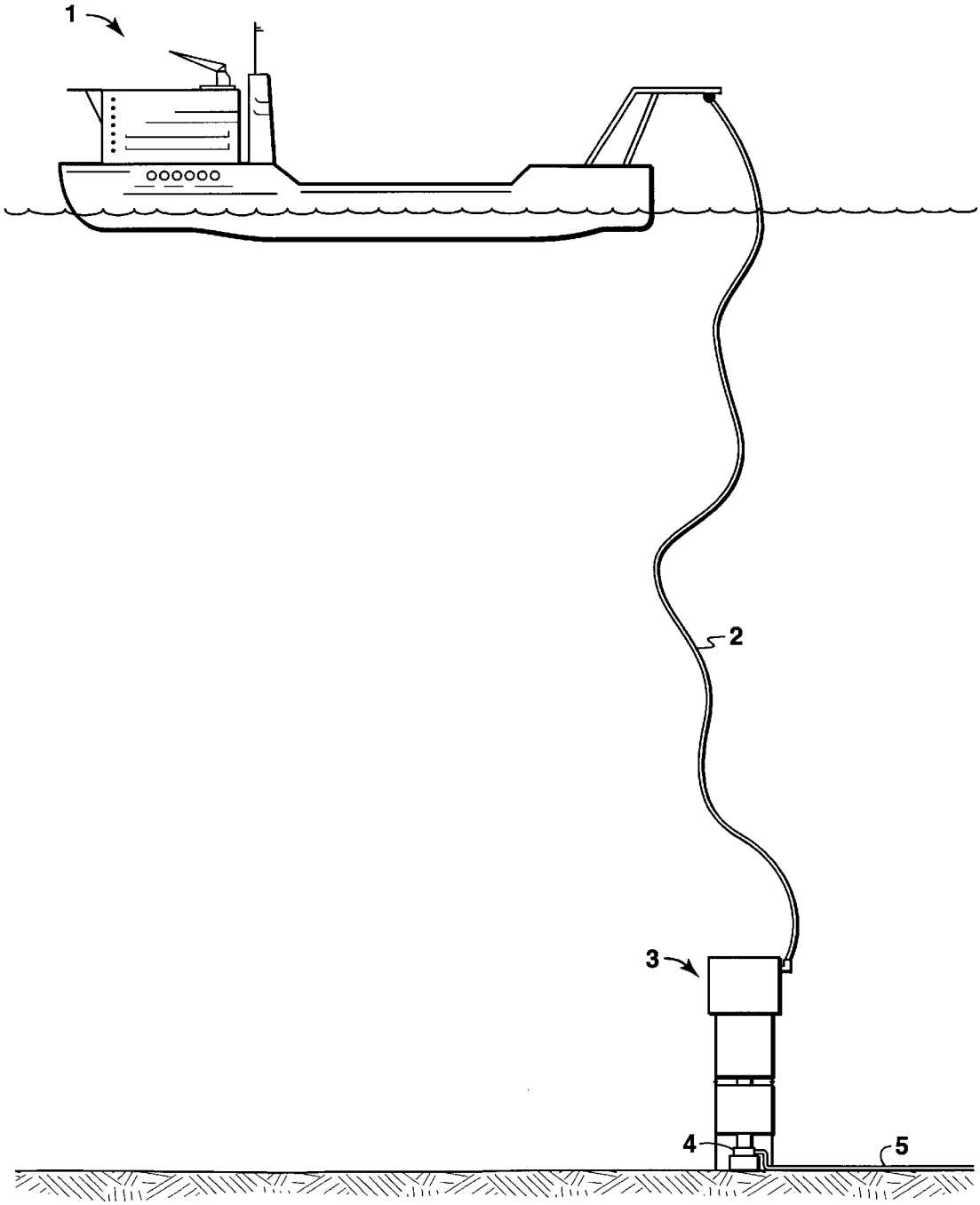
FIG. 1 is a schematic elevation view of the intervention system, deployed from a vessel on to the wellhead assembly or tree.

The present invention and its advantages will be better understood by referring to the following detailed description and the attached drawings. The present invention will be described in various embodiments. However, to the extent that the following description is specific to a particular embodiment or a particular use of the invention, this is intended to be illustrative only, and is not to be construed as limiting the scope of the invention.

The proposed invention lowers intervention cost through the novel use of existing technology, combining several existing technologies and/or techniques into a modular system for subsea use that is not restricted to any particular vessel. This invention eliminates the need for a drilling rig for many subsea interventions. In addition, conventional tensioned risers are not required, minimizing mooring and station keeping requirements without the risk incurred in a conventional "dynamic positioned" intervention.

The intervention system of the invention is a novel subsea deployed wire line, "stiff wire" (wire-line located inside reeled tubing or embedded in the tubing wall), or coil tubing unit landed on the existing subsea wellhead assembly or tree, wherein the unit includes as an additional novel component a "carousel" tool caddy. The carousel is utilized to allow the remote change-out of multiple tool strings that are installed in the carousel prior to deployment, thereby eliminating the requirement for a "riser" conduit to the surface, or the need to "trip" tools through the water column to the surface for tool replacement. This advantage is particularly important in deepwater locations, where the time required to trip tool strings is significant. Many of the other components of the intervention system are known for use in some phase of the oil and gas industry, although not necessarily in combination, or for use in a subsea application.

The intervention system, as designed, may be deployed from any crane or moonpool equipped vessel, landed on the subsea tree (regardless of configuration), pressure tested (via a self-contained subsea pump) and then operated remotely to execute "live" well interventions through a subsea blow-out-preventer assembly. In the basic configuration, the system will be capable of conducting well intervention activities such as reservoir monitoring (such as logging operations), flow control (via perforating or mechanically conveyed plugs, valves, etc.) and flow assurance (removal of hydrates, wax, and other contaminants). The invention system may also be employed in a similar manner to conduct repair or surveillance operations for pipelines or flowlines having flow control manifolds.

A typical operation sequence begins with transport of the assembled intervention system to the offshore worksite on any vessel capable of accommodating the intervention apparatus weight and volume. A dedicated drilling or well intervention vessel is not required; a small work boat with an auxilliary crane could be the most economic selection. Upon arrival at the surface location, a standard remote operated vehicle (ROV) locates the subsea well and pulls the external tree cap. The intervention system is then lifted off the deck and lowered on a landing cable. The work boat and ROV maneuver the intervention system over the existing subsea tree, and once over the wellhead, the intervention system is attached to the tree via a connector.

FIG. 1 illustrates placement of the intervention system at an offshore location. A marine vessel 1 has delivered the intervention system 3 connected to the vessel with a control umbilical cord 2, to the subsea tree 4. A pipeline 5 typically allows transport of produced oil or gas to surface facilities (not shown).

Control of the intervention system is established through an umbilical that is run with the landing cable or lowered separately and latched to the unit by the ROV. The umbilical bundle includes connections for power transmission, a circulating loop, and communications. Control and power modules enable the unit to be operated remotely from the surface. After landing the unit and establishing the umbilical connections, the pressure integrity of the connection to the tree or landing surface is tested using a subsea pump component controlled through the umbilical. Testing is performed with seawater or hydraulic test fluid contained within the intervention apparatus. Then the system is ready for use.

Figure 2:
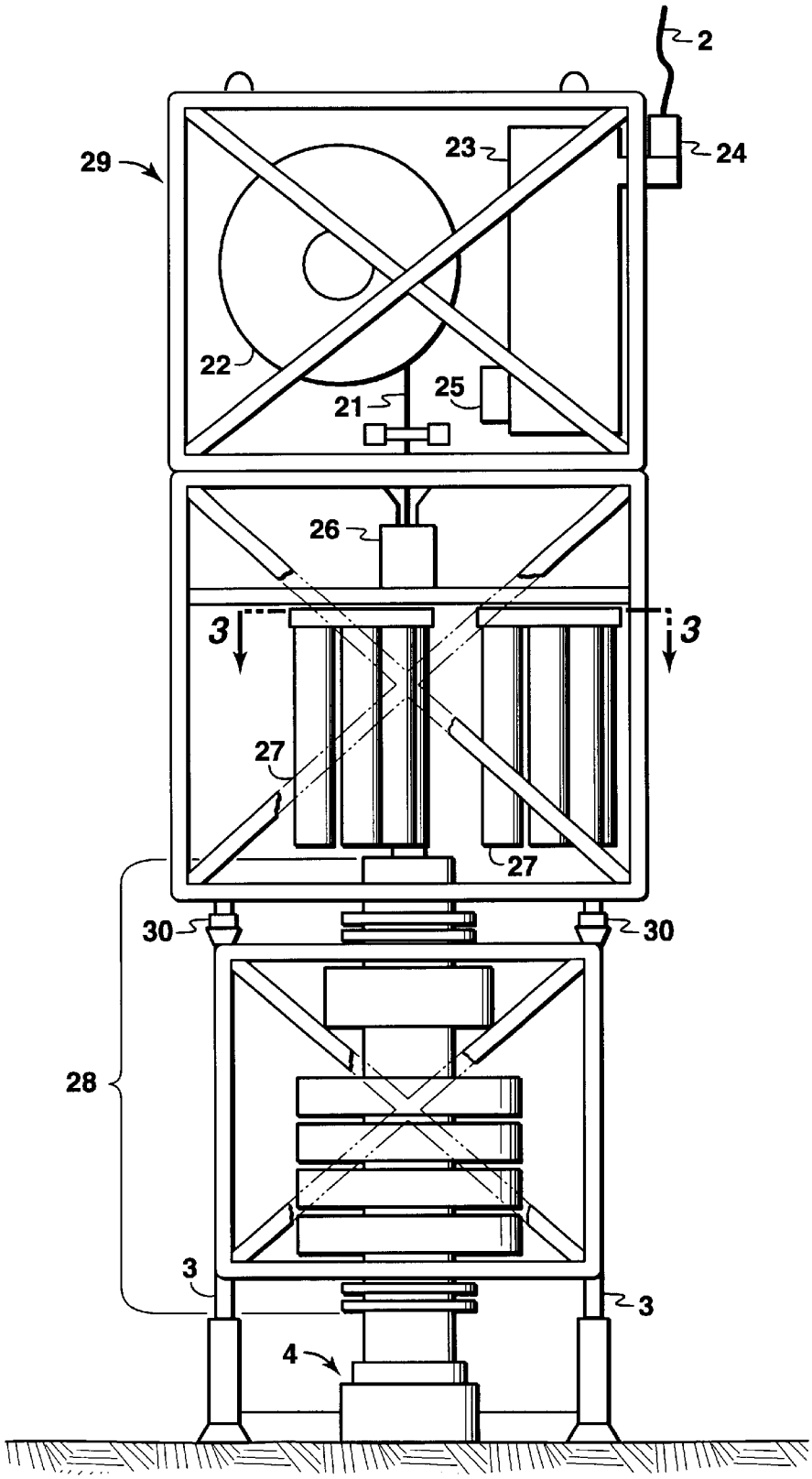
FIG. 2 is a schematic elevation view of the intervention system, including the carousel tool caddy, as it could be configured for wellbore operations.

FIG. 2 shows the intervention system, which has several major components, including coiled tubing or wireline 21, stored on an offset reel(s) 22 (with level wind device), a subsea power pack 23 with a control pod 24, capable of being stabbed into by an ROV, a low volume high pressure test pump 25, an injector head 26, a carousel tool handling system or tool caddy 27, housing the necessary tools for a particular job, and a coiled tubing blow out preventer (BOP) 28 (including upper and lower hydraulic connectors), all packaged in a three-dimensional space frame 29. This space frame will be capable of transferring loads through its members, around the internal intervention apparatus components, and into the existing subsea tree 4. The space frame may be disconnected into two sections at the space frame section connection joints 30.

The intervention system is simply enclosed inside a space frame to provide structural support for the components as they are transported, deployed, retrieved, or repaired. Some subsea trees may require an auxiliary support frame to transfer a portion of the load from the intervention system directly to the seabed, rather than only through the tree to the seabed. The complete intervention system is run and operated "wet" with no hyperbaric or protective enclosure required. However, individual components of the intervention system may be enclosed and/or pressurized to prevent the intrusion of seawater or contain wellbore pressure. For example, the reeled coiled tubing or stiffwire may need to be pressurized to prevent collapse of the tubing.

Figure 3:
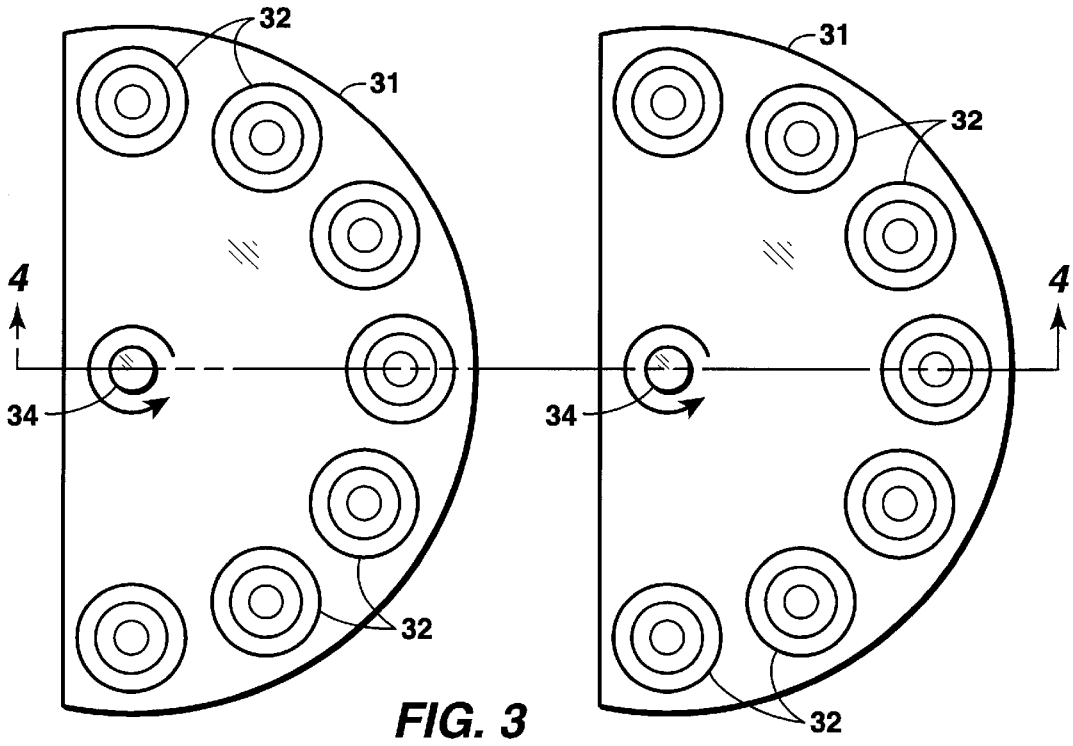
FIG. 3 is a top view illustration, taken along the line 3—3 in FIG. 2 of two carousel tool caddies included in an intervention system.

FIG. 3 shows a top view of two carousel tool caddies suspended within the space frame. Each tool caddy comprises an index plate 31 and tool canisters 32, which hold tools 33. Each index plate includes a rotation pin 34, which allows each tool caddy to rotate over the coiled tubing BOP assembly, in order to provide direct access to the wellbore for any tool canister.

Some tool configurations may require their tool canisters to contain wellbore pressure. Alternatively, the injector head may be located below the carousel with a provision for utilizing a "mini-injector" above the carousel. The optimum number of indexing plates or tool caddies for an intervention system will be determined by specific load requirements; i.e. lighter tool assemblies may allow utilization of a single "unbalanced" plate, while interventions requiring many small diameter tools may utilize more than two indexing plates. Two index plates or two tool caddies may be easiest to balance on the intervention system. To conduct interventions in wells completed with horizontal trees, a tool caddy will generally hold at least three tools, since the intervention system must remove a plug from the well prior to conducting an intervention activity, and place a new plug in the well once that activity is complete.

Figure 4:
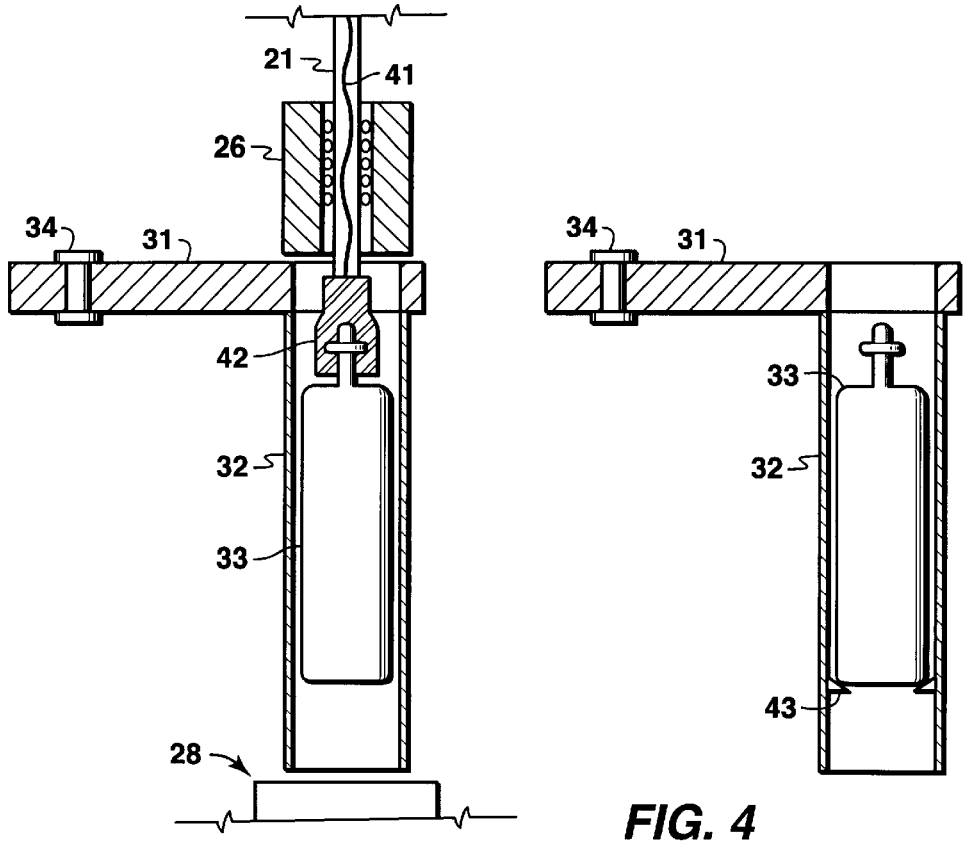
FIG. 4 is a cross-sectional view, taken along the line 4—4 in FIG. 3, illustrating the two carousel tool caddies included in the intervention system.

FIG. 4 shows a cross-sectional view of two tool caddies, illustrating coiled tubing 21 with attached tool connector 42, connected to tool 33, in tool canister 32. The coiled tubing includes a wire line 41 inside the coiled tubing, to allow control of the tool in the well. The coiled tubing enters the tool caddy located over the coiled tubing BOP assembly 28 through injector head 26. The tool caddy not located over the coiled tubing BOP assembly is also shown, with a tool 33 contained in a tool canister 32 with a tool catcher 43 engaged to hold the tool in the tool canister.

Having established connection and pressure integrity, the carousel tool caddy containing the various pre-loaded tools is rotated into position to center the first desired tool on the wellbore. The coiled tubing, stiff wire, wireline, reeled pipe, or other tool delivery device is passed through the injector head into the cartridge, connecting the tool via an electrical, hydraulic, and/or mechanical connection (wet connect). Using standard 'snubbing' techniques, the connected tool is injected through the upper stripper rubber and into the pressurized wellbore. In the case of re-entry to an existing wellbore, the first operation would typically be to remove any mechanical barriers previously installed to secure the well (caps, plugs, etc.) The removed barriers are pulled into and stored in the retrieving tool carousel.

A typical tool change operation involves returning a used tool to its canister, engaging the tool catcher and releasing the tool connector. The connector is then further retracted to a pre-determined point above a carousel. The indexing plate(s) then rotate to the next desired tool and the process is repeated, with the tool connector lowered and "locked" onto the tool, the tool catcher released and the tool "snubbed" into the pressurized well-bore.

In the event that tools are required that were not anticipated at the time of carousel loading prior to deployment to the seabed, or should more tools be needed than can be pre-loaded, provisions are included in the well intervention system to allow retrieving and loading of individual tools via an ROV. Alternatively, the well can be secured via the BOP module and the upper part of the well intervention assembly, including the carousel, disconnected at the space frame connection joints, and returned to the surface for reloading.

Using tools that are preloaded into the tool carousel, drilling, completion and well repair operations can be conducted at or near the sea floor. With standard snubbing techniques, known to those skilled in the art, these operations can be conducted under pressure, without the need to hydrostatically balance the formation pressure. In addition to conveying tools, the coiled tubing or reeled pipe serves to convey cable and may act as a conduit for pumping or circulating fluids.

Tools that might be used include logging sondes for well surveillance, devices for removing restrictions to flow such as wax or gas hydrates, tools for manipulating or installing flow control or shut-off devices (such as downhole chokes, plugs, or valves), and tools for conducting well repairs. Where the tool is an intervention or repair tool, what is inserted into the tool caddy will include not only the tool itself but also the device (e.g. plug) to be deployed or retrieved by the tool. Consequently, tool caddies and the canisters or cartridges in them, may be of various sizes.

The subject invention includes an improved method for conducting a well intervention activity from a subsea location using the intervention system, wherein the method includes the step of selecting a tool for the well intervention activity from a carousel tool caddy located in close proximity to the well. Well intervention activities include well surveillance (production logs, mechanical integrity logs, pressure surveys, and fluid sampling), flow control in producers and injectors (down hole choke and/or plug installation and removal), well repair/flow assurance (safety valve inserts, tubing patch, gravel pack repair/replacement, screen installation, and down hole welding), and removal of plugging agents (such as wax, paraffin, hydrates, and sand). The subject invention could also be used for well construction, well completion, and other applications.

In its preferred embodiment, the invention is used for stiff-wire or wireline (non-circulating) operations, however, the invention is also useful in circulating operations using stiffwire, coiled tubing, or reeled pipe, where fluids are circulated in either a "closed loop" (from surface, down wellbore, with returns back to surface) or "open loop" (either subsurface pumps, down well bore and back to either surface or production flowline, or surface pumps, downhole and out production flowline).

The means and method for practicing the invention, and the best mode contemplated for practicing the invention, have been described. It is to be understood that the foregoing is illustrative only, and that other means and techniques can be employed without departing from the scope of the invention as claimed herein. Changes and modifications in the specifically described embodiments can be carried out without departing from the scope of the invention which is intended to be limited only by the scope of the appended claims.

I claim:

1. An intervention system for servicing subsea wells or pipelines from a subsea location comprising:

(a) a tool delivery device;

(b) a reel to hold the tool delivery device;

(c) an injector head;

(d) a carousel tool caddy;

(e) a blow-out-preventer assembly;

(f) a power pack;

(g) a control pod;

(h) a test pump; and (i) an open space frame.

2. The system of claim 1 wherein the tool delivery device is selected from the group consisting of wire line, stiff wire, coiled tubing, and reeled pipe.

3. The system of claim 2 wherein the intervention system includes as an additional component a control umbilical cord.

4. The system of claim 3 wherein the tool delivery device is wire line.

5. The system of claim 3 wherein the tool delivery device is stiff wire.

6. The system of claim 3 wherein the tool delivery device is coiled tubing.

7. The system of claim 2 wherein the tool caddy comprises an index plate and three or more tool canisters holding three or more tools.

8. The system of claim 7 wherein the intervention system comprises at least two tool caddies.

9. The system of claim 8 wherein the tools in the tool caddy are held in place with tool catchers.

10. The system of claim 8 wherein one or more tool canisters are enclosed to prevent the intrusion of seawater and contain wellbore pressure.

11. The system of claim 3 wherein the intervention system allows replacement of a tool in a tool caddy by a remotely operated vehicle.

12. The system of claim 3 wherein the space frame can be disconnected into two sections, a first section comprising a carousel tool caddy, and a second section comprising a blow-out-preventer assembly, wherein the first section may be removed from the second section, to allow replacement of tools in the tool caddy.

13. A method for introducing a tool into a subsea well from a subsea location using the system of claim 3.

14. A method for introducing a tool into a subsea well from a subsea location comprising:

(a) connecting a well intervention system to a subsea tree, wherein the well intervention system includes a reeled tool delivery device and a carousel tool caddy capable of holding one or more tools;

(b) rotating the carousel tool caddy so that a selected tool is located over the well;

(c) connecting a tool delivery device to the selected tool; and (d) introducing the selected tool into the well.

15. The method of claim 14 wherein the tool delivery device is selected from the group consisting of wire line, stiff wire, coiled tubing, and reeled pipe.

16. The method of claim 15 wherein the tool delivery device is wire line.

17. The method of claim 15 wherein the tool delivery device is stiff wire.

18. The method of claim 15 wherein the tool delivery device is coiled tubing.

19. The method of claim 15 wherein the tool caddy comprises an index plate and three or more tool canisters holding three or more tools.

20. The method of claim 15 including the additional step of replacing a tool in the tool caddy with another tool using a remotely operated vehicle.

21. The method of claim 15 including the additional steps of securing the well using a blow-out-preventer assembly included in the well intervention system, disconnecting the space frame into two sections, and removing the section containing the carousel tool caddy, to allow replacement of tools in the tool caddy.

22. The system of claim 3 wherein the reel holding the tool delivery device is pressurized.

23. The system of claim 3 wherein the tool delivery device is pressurized.

24. The method of claim 14 wherein the tool caddy is located in close proximity to the well.

25. The method of claim 14 wherein one or more tool canisters are enclosed to prevent the intrusion of seawater and contain wellbore pressure.

26. An intervention system for servicing a subsea well from a subsea location without a riser comprising:

(a) a tool delivery device, wherein the tool delivery device is selected from the group consisting of wire line, stiff wire, coiled tubing, and reeled pipe;

(b) a reel to hold the tool delivery device;

(c) a carousel tool caddy to hold well intervention tools;

(d) a blow-out-preventer assembly to connect to a subsea wellhead assembly on the subsea well;

(e) an injector head to direct the tool delivery device from the reel into the tool caddy, through the blow-out-preventer assembly, and into the well;

(f) a control umbilical for establishing remote power transmission and control communications;

(g) a power pack to supply power to the intervention system;

(h) a control pod to enable remote operation of the intervention system; and (i) an open space frame to provide structural support for components of the intervention system.

27. The system of claim 26 wherein the intervention system includes as an additional component a subsea pump for testing pressure integrity of a connection between the intervention system and the well.

28. The system of claim 26 wherein the tool caddy comprises an index plate and three or more tool canisters.

29. The system of claim 28 wherein one or more tool canisters are enclosed to prevent the intrusion of seawater and contain wellbore pressure.

30. The system of claim 26 wherein the intervention system comprises at least two tool caddies.

31. The system of claim 26 wherein the reel holding the tool delivery device is pressurized.

32. The system of claim 26 wherein the tool delivery device is pressurized.

33. The system of claim 26 wherein the tool caddy is located in close proximity to the well.

34. The system of claim 26 wherein the intervention system allows replacement of a tool in a tool caddy by a remotely operated vehicle.

35. The system of claim 26 wherein the space frame can be disconnected into two sections, a first section comprising a tool caddy, and a second section comprising a blow-out-preventer assembly, wherein the first section may be removed from the second section, to allow replacement of tools in the tool caddy.

36. A method for introducing a tool into a subsea well from a subsea location without a riser using the system of claim 26.

37. A method for introducing a tool into a subsea pipeline from a subsea location comprising:

(a) connecting an intervention system to a subsea pipeline manifold, wherein the intervention system includes a reeled tool delivery device and a carousel tool caddy capable of holding one or more tools;

(b) rotating the carousel tool caddy so that a selected tool is located over the manifold;

(c) connecting a tool delivery device to the selected tool; and (d) introducing the selected tool into the manifold, and thereby into the pipeline.

38. The method of claim 37 wherein the tool caddy is located in close proximity to the pipeline.

39. The method of claim 37 wherein the tool delivery device is selected from the group consisting of wire line, stiff wire, coiled tubing, and reeled pipe.

40. The method of claim 37 wherein the tool caddy comprises an index plate and three or more tool canisters.

41. The method of claim 37 including the additional step of replacing a tool in the tool caddy with another tool using a remotely operated vehicle.

* * * * *